United States Patent [19]

Ichikawa et al.

[11] 4,219,999

[45] Sep. 2, 1980

[54] ELECTRONIC TIMEPIECE EQUIPPED WITH BATTERY LIFE DISPLAY

[75] Inventors: Singo Ichikawa, Sayama; Yoshiaki Kato, Higashimurayama, both of Japan

[73] Assignee: Citizen Watch Company, Limited, Tokyo, Japan

[21] Appl. No.: 882,939

[22] Filed: Mar. 2, 1978

[30] Foreign Application Priority Data

Mar. 3, 1977 [JP] Japan ..... 52-22202
Jul. 26, 1977 [JP] Japan ..... 52-89671

[51] Int. Cl.[2] ..... G04C 3/00; G04B 37/12

[52] U.S. Cl. ..... 368/66; 368/80

[58] Field of Search ..... 58/23 R, 23 BA, 23 D, 58/23 AC, 23 A, 152 H; 340/636, 648, 660–663

[56] References Cited

U.S. PATENT DOCUMENTS

| | | | |
|---|---|---|---|
| 3,812,670 | 5/1974 | Nikaido et al. | 58/23 D X |
| 3,832,629 | 8/1974 | Cerhek, Jr. | 340/636 |
| 3,949,545 | 4/1976 | Chihara | 58/25 BA |
| 3,998,043 | 12/1976 | Tamaru et al. | 58/23 R |
| 4,014,164 | 3/1977 | Fujita | 58/23 BA |
| 4,028,880 | 6/1977 | Ueda | 58/23 BA |
| 4,041,691 | 8/1977 | Chihara et al. | 58/23 BA |
| 4,043,112 | 8/1977 | Tanaka | 58/23 BA |
| 4,129,981 | 12/1978 | Nomura et al. | 58/23 D |

*Primary Examiner*—Vit W. Miska

[57] ABSTRACT

An electronic timepiece equipped with a battery life warning system, in which an output voltage of a battery are detected under a heavy load condition and a light load condition. In a first preferred embodiment, a time indicating means effects a display of time in a first predetermined more to provide an initial warning of the battery life when the output voltage drops below a first predetermined level during the heavy load condition and also effects of the display of time in a second predetermined mode to provide a second warning of the battery life when the output voltage of the battery drops below a second predetermined level lower than the first predetermined level. In a second preferred embodiment, when the output voltage of the battery drops below the first predetermined level, a drive signal for driving the time indicating means is produced so as to drive the time indicating means with a sufficient driving energy substantially equal to that of a drive signal being produced when there is no voltage drop in the battery. When the output voltage of the battery drops below the second predetermined level, a control signal is applied to the time indicating means, which is consequently rendered to display the time information in a modulated form for thereby providing a warning of the battery life.

21 Claims, 10 Drawing Figures

FREQUENCY DIVIDER
F9
Fn
F15
F16
F17
O.S.C.
SAMPLING SIGNAL GENERATING CIRCUIT
FIRST SAMPLING SIGNAL
SECOND SAMPLING SIGNAL
STEPPING MOTOR
DISPLAY PULSE SELECTOR CIRCUIT
FIRST CONTROL SIGNAL
BATTERY VOLTAGE DETECTION CIRCUIT
LEVEL ADJUSTING REGISTER
D Q1 ST
D Q2 ST
CS
VDD
VSS
O1
O2
C1
C2
S
2
4
6
8
10
12
16
17
18
20
22
24
26
28
30
32
34
36
38
40

ELECTRONIC TIMEPIECE EQUIPPED WITH BATTERY LIFE DISPLAY

This invention relates to a battery life warning system and, more particularly, to an electronic timepiece equipped with such a battery life warning system.

In the design of electronic timepieces, it is desirable that means be provided to warn the user that battery replacement is necessary. Since the timekeeping circuits of the timepiece will cease to operate when the battery voltage reaches a certain minimum voltage near the end of the battery life, the warning to the user should ensure a sufficient time margin before such a minimum voltage is actually reached. There have been various proposals in the prior art whereby the battery voltage is monitored, continuously or periodically, and a warning given to the user when the voltage falls below a predetermined minimum level, to indicate that replacement is necessary. However, due to variations in the characteristics of batteries, it is possible that the timepiece will continue operation for a few weeks, in some cases or for a few days in other cases, after the battery voltage has fallen below the predetermined level. A means is therefore desirable whereby the user is given a clear indication of the degree of urgency of battery replacement, thereby reducing the probability of the timpiece ceasing to operate and requiring to be reset when new batteries are installed.

Another problem arises from the fact that the internal resistance of the battery increases with decreased operating temperature. Thus, when the battery is approaching the end of its life, at some low operating temperature, and when relatively heavy load is applied (such as when motor drive pulses are generated, in a timepiece employing a stepping motor), the battery voltage may drop to a level at which it cannot properly supply the load, or to a level at which the operation of the timekeeping circuits is affected.

The present invention is directed towards improvement of the battery life warning system, and to ensuring that the maximum available energy of the battery can be utilized irrespective of changes in battery characteristics caused by aging and temperature variations. As a battery approaches the end of its life there is a relatively gradual increase in its internal resistance, resulting in an increasing drop in battery output voltage when a heavy load is applied. When the battery is very close to the end of its life, the output voltage under light load conditions begins to drop rapidly. In the present invention, therefore, the battery voltage is periodically measured alternately under a heavy load condition and under a light load condition. In one embodiment of the invention, a part of the time indicating display, which is of conventional form, i.e. with rotating hands or digital readout, is varied in two stages to provide battery life warning signals. When the battery voltage falls below a certain voltage while a heavy load is applied, then the first stage warning signal is given, for example by advancing the seconds hand once every two seconds instead of once every second. This provides a preliminary warning to the user that battery replacement is desirable. When the battery voltage falls below another predetermined voltage while a light load is applied, the second stage warning signal is given, for example by advancing the seconds hand once every four seconds. This provides a warning to the user that battery replacement is urgently required.

In another embodiment of the present invention, the type of second stage warning signal described in the previous paragraph is displayed when the battery voltage falls below the critical level under light load. In addition, if the battery voltage falls below another predetermined level under heavy load, then this condition is detected and the way in which power is supplied to that heavy load is modified accordingly. For example, the width of drive pulses applied to a stepping motor may be increased, to ensure that there is sufficient torque produced to drive the motor under the condition of low battery voltage. Or, in the case of a timepiece with a liquid crystal type of display, the transient load could be caused by the user turning on a built-in lamp in the timepiece to read the time under low ambient lighting conditions. In this case, the output of the battery voltage detection circuit can be used to control the time for which the built-in lamp remains turned on. This serves to ensure that the battery voltage does not fall to a level at which operation of the timekeeping circuits is affected.

It is therefore an object of the present invention to provide an improved electronic battery-operated timepiece.

Another object of the present invention is to provide a battery-operated electronic timepiece with improved means whereby a warning indication is displayed of the approach of the end of the battery life.

More particularly, it is an object of this invention to provide means whereby the battery voltage is detected under the conditions of both light and heavy battery load, and a warning displayed if the battery voltage should fall below a certain predetermined level, in either load condition.

It is a further object of this invention to provide a battery-operated electronic timepiece with means whereby the drop in battery voltage below a certain predetermined level under the condition of light battery load is detected, and a control signal generated as a result of this detection, the control signal being used to control one or more timepiece functions.

These and other objects, features and advantages of the present invention will be more apparent from the following description when taken in conjunction with the accompanying drawings, wherein.

Figure 1:
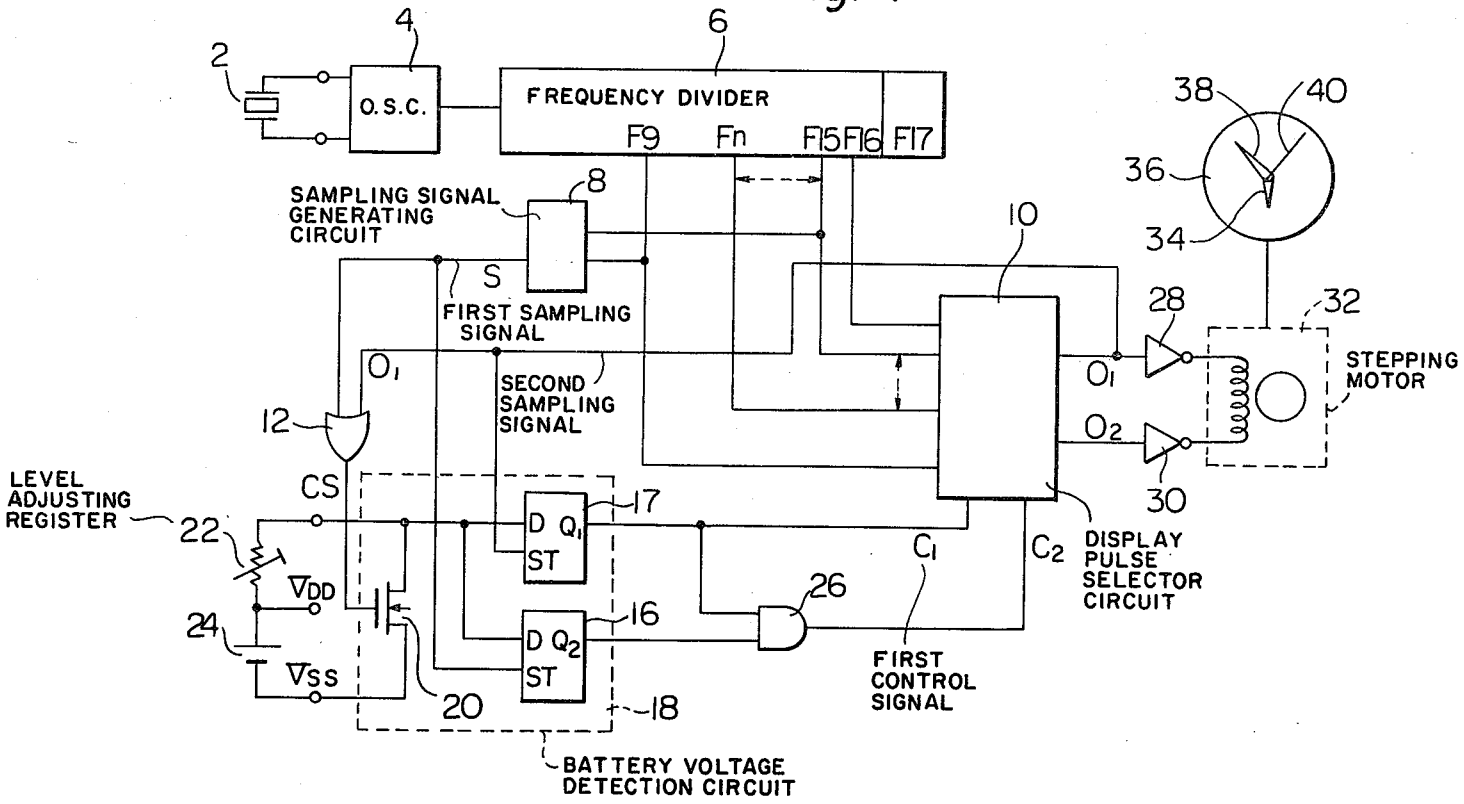
FIG. 1 is a simplified block diagram of the major circuit sections of a timepiece constructed in accordance with a first embodiment of the present invention.
Figure 6:
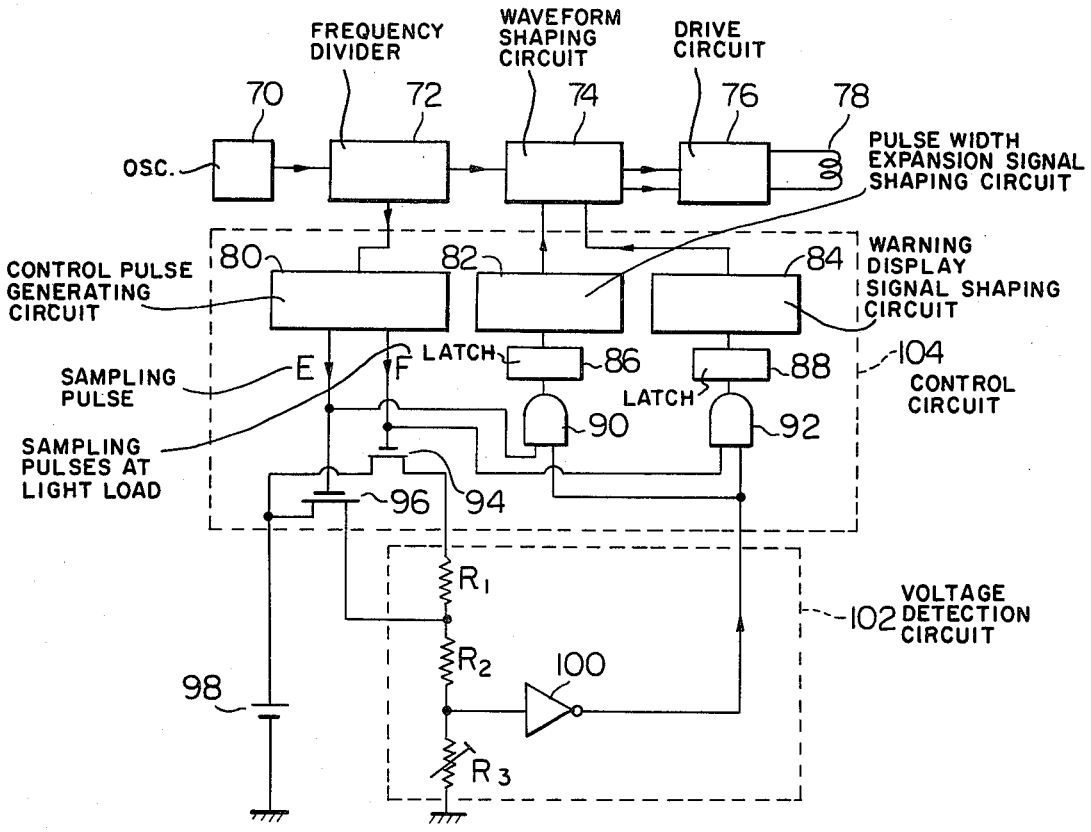
FIG. 6 is a block diagram illustrating the major circuit sections of a timepiece constructed in accordance with a second embodiment of the present invention, in which the width of pulses applied to a timepiece display stepping motor is increased in accordance with a drop in battery voltage under heavy load.
Figure 9:
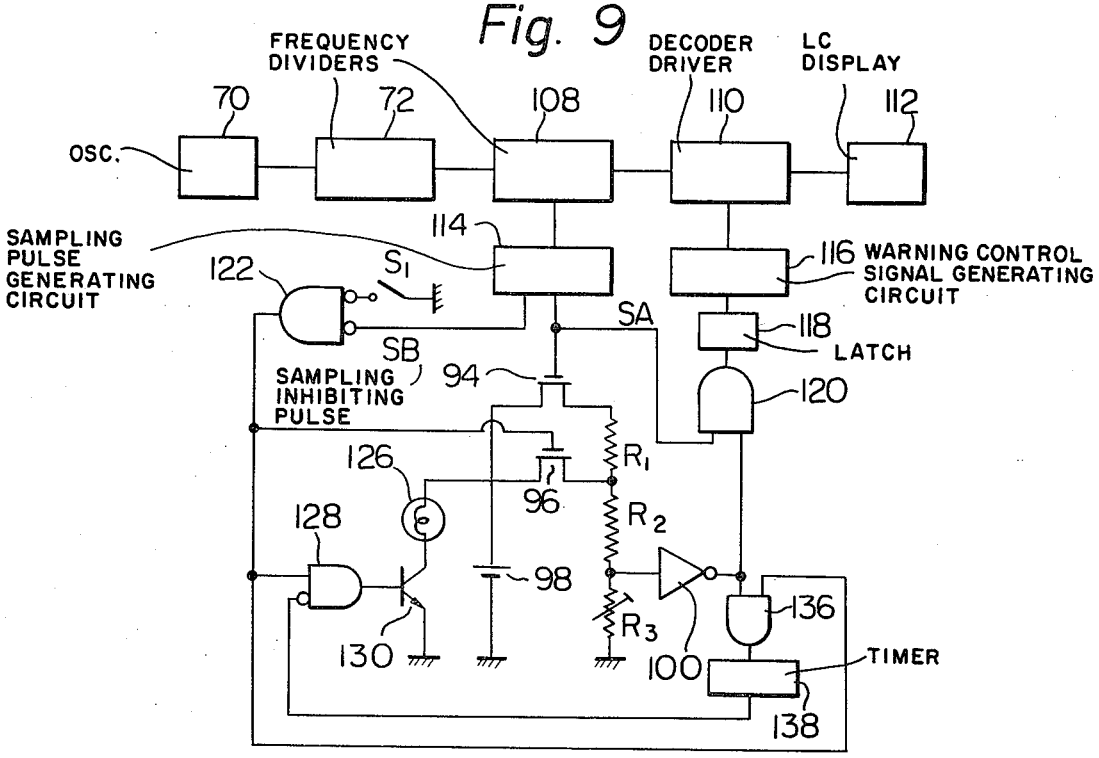
Figure 10:
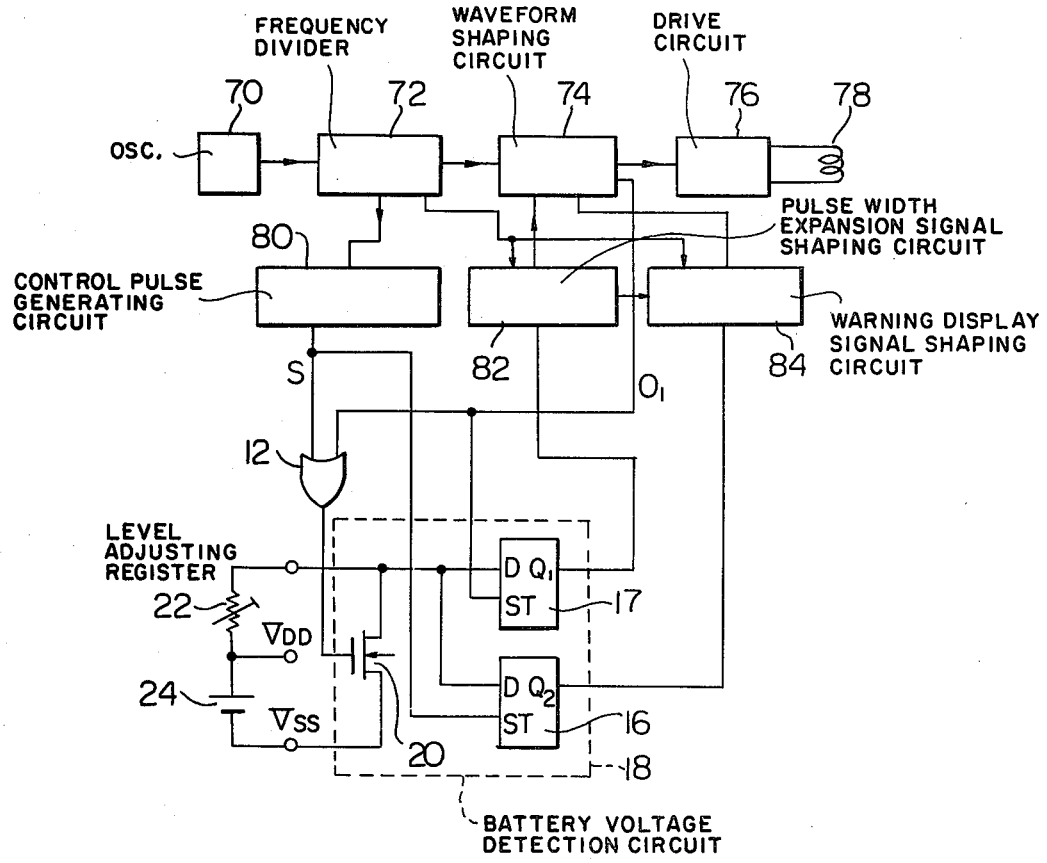

FIG. 9 shows a modification of the second embodiment of the present invention, in which duration of the ON state of a lamp used to illuminate a liquid crystal timepiece display is controlled in accordance with the level of the battery voltage, when the battery is loaded by the illuminating lamp; and FIG. 10 shows a modification of the second embodiment which is shown in FIG. 6, such that the battery voltage detection circuit of the first embodiment, shown in FIG. 1, is utilized.

Referring now to the diagrams, FIG. 1 is a block diagram of circuitry for a first embodiment of this invention. Numeral 2 indicates a quartz crystal vibrator which is combined with an oscillator circuit 4 to form a frequency standard. The output of the oscillator 4 is applied to a frequency divider 6, comprising seventeen divider stages. The output signal from the final frequency divider stage F17 has a period of 4 seconds. Output signals from the divider stages are applied to a display pulse selector circuit 10, to which are also applied signals supplied from a battery voltage detection circuit 18 and an AND gate 26. Output signals $O_1$ and $O_2$ from circuit 10 are amplified by driver circuits 30 and 28, the outputs from which serve to drive a stepping motor 32. Stepping motor 32 serves to actuate the hands of an analog type time display, such that in the normal mode of operation of the timepiece, i.e. when the battery voltage is normal and in which signals $O_1$ and $O_2$ constitute standard time signals, the time display is advanced by an angle representing one second each time an output signal pulse $O_1$ or $O_2$ is applied to the driver circuits 28 and 30 from circuit 10. In other words, the seconds hand 40 shown on the timepiece display face indicated by numeral 8, is advanced once. Numerals 34 and 38 indicate the hours and minutes hands respectively.

The battery voltage detection circuit 18 contains two data type flip-flops (referred to hereinafter as DFFs) 16 and 17 and a P-channel MOS transistor 20. The data terminals D of DFF 14 and 15 are connected to the negative terminal Vdd of the battery 24 through a level adjusting resistor 22. The source terminal of transistor 20 is connected to the positive terminal Vss of battery 24. The outputs of FF15 and FF9 in frequency divider 6 are applied to a sampling signal generating circuit 8, to produce a first sampling signal S. This is applied to the sampling terminal ST of DFF 16, and to an OR gate 12 which outputs pulses CS. Output signal $O_1$ of display pulse selector circuit 10 is also utilized as a second sampling signal and is applied to OR gate 12. The output from OR gate 12 is connected to the gate terminal of transistor 20. The output Q1 of DFF 17 is applied to display pulse selector circuit 10 as control a first signal C1 and also to AND gate 26. Output Q2 of DFF 16 is also applied to AND gate 26, whose output is applied to display pulse selector circuit 10 as a second control signal C2.

The operation of the battery voltage detection circuit 13 will now be described.

Sampling pulses $O_1$ are generated at times when the battery is subjected to a heavy load, i.e. when drive pulses are being applied to the stepping motor. Pulses $O_1$ are applied to the gate of transistor 20 through gate 12, the output of gate 12 being sampling pulses CS. Thus, if the battery voltage (and hence the amplitude of sampling pulses CS is sufficiently high when sampling pulses are applied to transistor 20, the transistor will conduct and thereby present a very low impedance at its drain terminal. Thus, a voltage close to zero will appear at sampling terminal ST of DFF 16 when pulses $O_1$ are applied to the data input terminal of DFF 16, and output Q2 will remain at the low level. If, however the battery voltage (and hence the amplitude of pulses CS is at a certain low level, then transistor 20 will only conduct partially or not at all. Thus, a voltage will appear at sampling terminal ST of DFF 17 when sampling pulses $O_1$ are applied to the D terminal of DFF 17. This voltage is the first detection signal. The output of Q2 of DFF 17 will therefore go to the high level. First control signal C1 is thereby produced.

It should be noted that the voltage developed across the drain and source terminals of transistor 20 when this transistor is in a partially conducting condition due to a low level of sampling pulse applied to its gate, will be determined by the value of resistor 22. Thus the battery voltage level at which an output control signal is generated by DFF 17 can be set by adjusting the value of resistor 22 at the time of manufacture. Sampling pulses S are produced from circuit 8 when the battery is subjected to a light load, i.e. when stepping pulses are not being supplied to the stepping motor, in the case of the example being described. Sampling pulses S are applied to OR gate 12 to produce sampling pulses CS and to the ST terminal of DFF 16. As in the case of sampling pulses $O_1$ described above, if the battery voltage is above a certain minimum level, then pulses CS will cause the gate threshold voltage of transistor 20 to be exceeded so that is becomes conducting, and thus output Q2 of DFF 16 will remain at a low level when pulses S are applied to sampling terminal ST of DFF 16. When the battery voltage falls to a certain minimum level, whose value is determined by the value of resistor R22, then a voltage will appear across the source and drain terminals of transistor 20 when pulses S are applied to terminal ST of DFF 16. This voltage is the second detection signal. As a result, the output Q2 of DD16 will go to the high level. The combination of this output with control signal C2 applied to AND gate 26 causes AND gate 26 to generate control signal C2. It should be noted that control signal C1 will be generated some time in advance of control signal C2, during the life of the battery, since the voltage drop of the battery under heavy load is invariably greater than the voltage drop under light load. Thus, this battery voltage detection circuit produces control signals in two stages, e.g. control signal C1 when the increase of battery internal resistance has reached a certain minimum level near the end of the battery life, and control signal C2 when the voltage of the battery has reached the same minimum level with a light load applied to the battery, indicating that the battery is rapidly approaching the end of its life.

Figure 2:
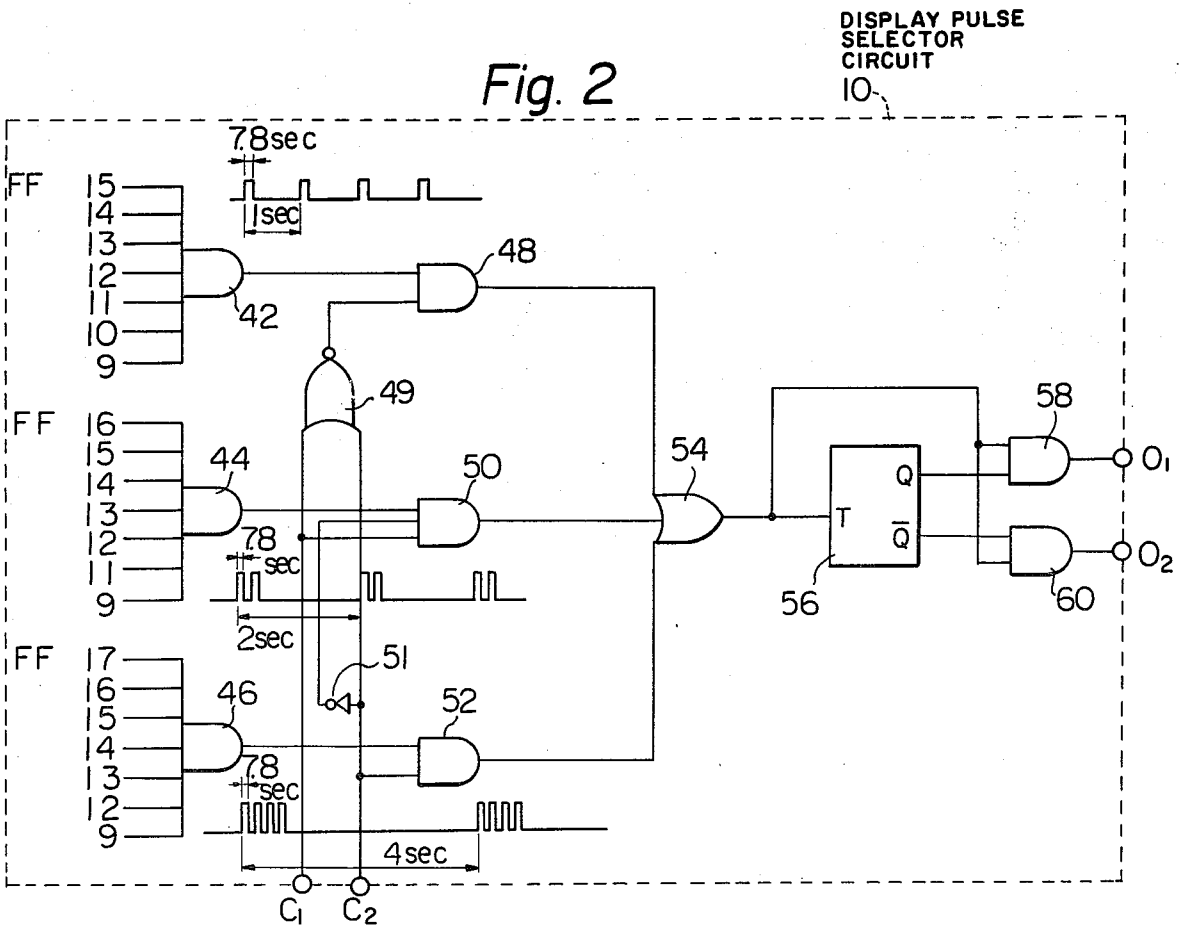
FIG. 2 is a diagram illustrating the circuit arrangement of block 4 in FIG. 1.

The operation of the display pulse selector circuit 10 will now be described. Referring to FIG. 2 and the waveforms of FIG. 3, the outputs FF15 to FF9 of frequency divider 6 are applied to AND gate 42 to produce pulses of width 7.8 msec, for example, and period of 1 second. These are applied to one input of AND gate 48. Control signals C1 and C2 are applied to NOR gate 49 so that when neither control signal is being produced the output of gate 49 is at the high logic level. The output pulses from gate 42 are thereby enabled to pass through gate 48, the output of which is applied to OR gate 54. The output of gate 54 is applied to the latch input of latch-type flip-flop 56 and to inputs of AND gates 58 and 60, to which the Q and $\overline{Q}$ outputs of FF 56 are also applied, respectively. Successive pulses from gate 54 cause outputs Q and Q of 56 to alternately latch at the high logic level, thus alternately enabling gates 58 and 60. In this way, successive pulses from gate 54 result in pulses being output alternately from gates 58 and 60, as signals $O_1$ and $O_2$ respectively.

Thus, when both C1 and C2 are not being produced, there is a period of one second between each $O_1$ pulse and the succeeding $O_2$ pulse. Outputs FF9 to FF16 of frequency converter 6 are applied to the inputs of AND gate 44. As a result, pairs of pulses with a width of 7.8 msec. and with a period of 15.6 msec. between each pulse of a pairs, and a period of 2 seconds between each successive pulse pair are output from AND gate 44. These are applied to AND gate 50, to which control signal C1 is also applied. The output of gate 50 is applied to OR gate 54. Thus, when control signal C1 is being produced, gate 50 is enabled to pass the output of gate 44. Signals $O_1$ and $O_2$ which are thereby produced result in the waveform shown in (i) of FIG. 3 being applied to the windings of stepping motor 32. The seconds hand of the timepiece will thereby be advanced by two steps at a time, with an interval of two seconds between each pair of steps. The timepiece user is thereby given advance warning of approaching battery failure.

At this time, gate 49 is inhibited, by the output of NOR gate 49, as a result of control signal C1.

Figure 3:
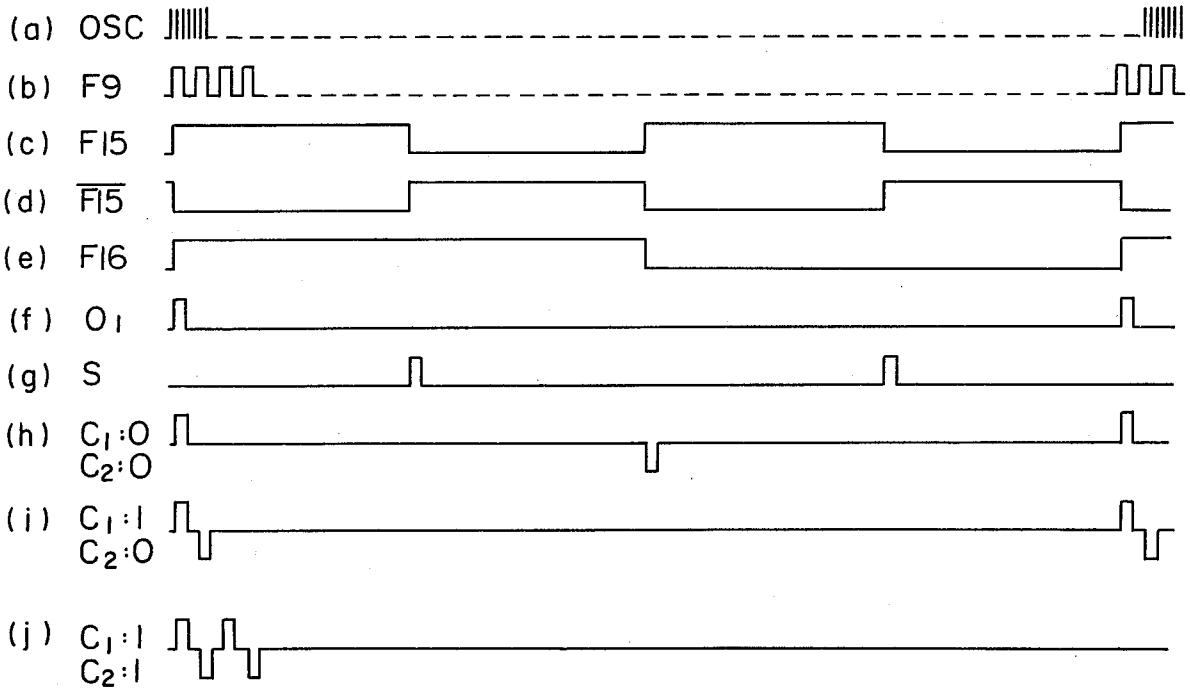
FIG. 3 shows the operating waveforms for the contents of FIG. 1 and FIG. 2.

Outputs FF9 to FF17 are applied to AND gate 46 from frequency divider 6, to generate groups of four successive 7.8 msec. pulses as indicated in FIG. 2, the period between each group being 4 seconds. These are applied to AND gate 52, to which the control signal C2 is also applied. Thus, when control signal C2 is being produced, the output pulses from gate 46 are passed through AND gate 52 to OR gate 54. As a result, drive pulses with the waveform shown in (j) of FIG. 3 are applied across the windings of stepping motor 32. The seconds hand of the timepiece is thereby advanced in groups of four immediately consecutive steps, the amplitude of each step corresponding to an indication of one second. Each group of these steps is separated by an interval of 4 seconds. The user is thereby warned that battery failure is imminent, and that immediate battery replacement is urgently required.

At this time, gate 50 is inhibited by the action of control signal C2 through inverter 51.

Figure 4:
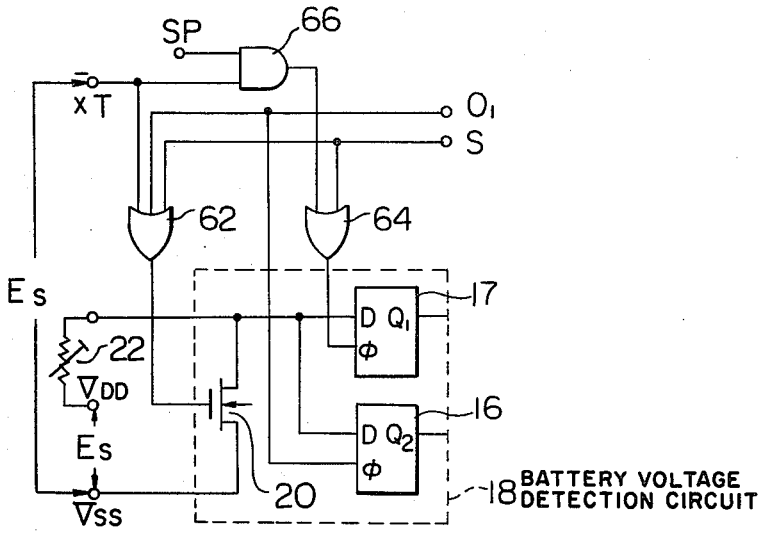
FIG. 4 is a diagram of circuitry whereby the value of resistor 17 shown if FIG. 1 may be easily adjusted at the time of manufacture of the timepiece.

FIG. 4 shows a modification of a part of the circuit of FIG. 1, whereby the value of the resistor 22 can be rapidly adjusted to provide generation of the battery warning signals at a desired level of battery voltage. In the circuit of FIG. 4, AND gates 66 and OR gates 62 and 64 are added to the circuit of FIG. 1, together with terminal XT to which an external source of voltage Es is connected, before a battery is inserted in the timepiece. Es is also connected across battery terminals Vdd and Vss. High speed sampling pulses at a frequency of 16384 Hz are applied to terminal ST at input to gate 66 from an external source, while Es is varied. To perform adjustment of resistor 22, Es is first set to the level at which battery warning should be displayed.

Resistor 22 is then varied until a battery warning indication appears on the timepiece time display.

Use of the circuit shown in FIG. 4 enables resistor 22 to be rapidly adjusted. This is because the connections shown for pulses SP and Es provide effectively continuous sampling, from the viewpoint of the person performing adjustment, as opposed to the normal sampling pulse rate of one pulse per second.

Figure 5:
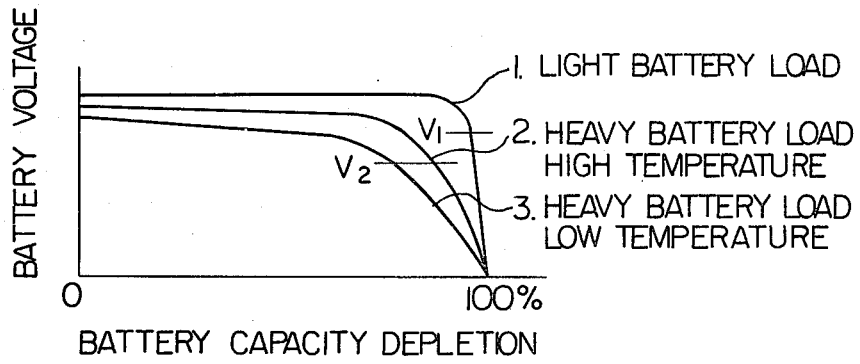
FIG. 5 shows the relationships between load, operating temperature, and battery output voltage during the life of a battery.

Referring now to FIG. 5, the voltage characteristics with time of a timepiece battery are illustrated in a general way. It is clear that, as the battery approaches the end of its life, the voltage which it supplies under light load (curve 1) begins to drop very rapidly. The voltage under heavy load, on the other hand, drops in a much more gradual fashion near the end of battery life (curves 2 and 3). Also, the voltage delivered by the battery under heavy load is lower at a low operating temperature than at a high operating temperature, throughout the life of the battery and particularly as the end of battery life starts to approach. If, now, the level at which a warning signal will be delivered to the timepiece user is set at V2 in FIG. 5, it is clear that a warning would be delivered at an earlier stage of battery life in the case of operation at the temperature of curve 3 than for operation at the temperature of curve 2. Thus, if the timepiece were temporarily used at a low temperature, a premature warning signal could be displayed, which would cease upon return to a normally warm operating environment. Another problem which can be caused by temperature changes is that the drop in battery voltage due to operation at a low temperature may result in incorrect operation towards the end of the battery life. For example, there may be insufficient torque generated by the drive pulses to provide motor actuation, in the case of a stepping type motor timepiece.

Referring now to FIG. 6, blocks 70 and 72 represent timing frequency standard oscillator and frequency divider circuits respectively, and generally correspond to blocks 2, 4 and 6 previously described in FIG. 1 of the first embodiment. The output of frequency divider 72 is applied to a waveform shaping circuit 74, which generates pulses to be applied to a drive circuit 76. As a result, drive circuit 76 produces alternate positive and negative-going drive pulses across the winding of stepping motor 78. The width of the pulses output by waveform shaping circuit 74 can be controlled, as described below.

A control circuit, 104, generates control signals which are input to waveform shaping circuit 74 in response to output signals from a voltage detection circuit 102. Control circuit 104 is composed of a control pulse generating circuit 80, switching elements 96 and 94 AND gates 90 and 92 latch circuits 86 and 88, a pulse width expansion signal shaping circuit 82, and a warning display signal shaping circuit 84. Voltage detection circuit 102 is composed of an inverter 100, resistors R1 and R2, and a presettable resistor R3.

Figure 8:
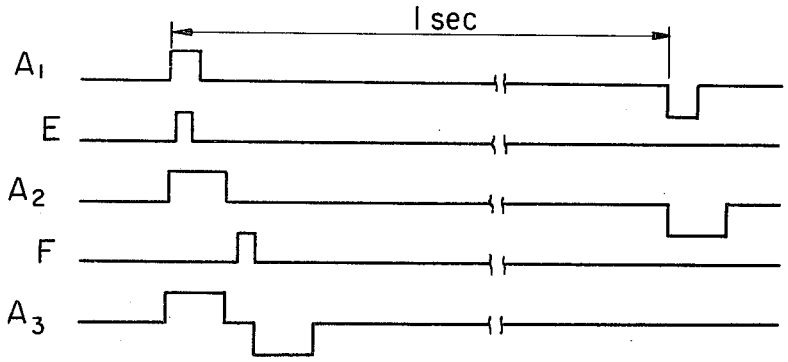
FIG. 8 shows operating waveforms for FIG. 7.

Referring now to the waveforms shown in FIG. 8, the waveform developed across the stepping motor 78 when the battery voltage is above both the light load and heavy load threshold levels V1 and V2 in FIG. 5 is shown as A1. The period between pulses of alternate polarity is 1 second, and the pulse width is 1/128 second, for example. Sampling pulses E are generated during periods when the motor coil is being driven, so that the battery is heavily loaded. When a pulse E is produced, switching elements 96 becomes conducting, so that the voltage of battery 98 is applied to the junction of R1 and R2, the voltage polarity being negative for the circuit arrangement shown. R3 is adjusted so that the voltage developed across it as a result of the battery voltage being applied to the series combination of R2 and R3 is the threshold voltage of the inverter, when the battery voltage is at level V2. Thus, when a pulse E is produced with the battery voltage below level V2, a positive pulse will be output from inverter 100, and is applied to AND gates 90 and 92. The resultant output pulse from AND gate 90 is stored in latch 86. As a result, circuit 82 generates a pulse width expansion signal which is input to waveform shaping circuit 74. This causes the width of the pulses applied to drive circuit 76 for circuit 74 to be expanded, to, for example 1/64 second. The waveform appearing across the stepping motor coil will therefore become as shown by A2 in FIG. 8. This pulse width expansion ensures that there will be sufficient energy applied to the stepping motor to ensure continued operation even when the battery voltage under heavy load falls below level V2. If such a drop were due to the timepiece being temporarily used in an unusually low ambient temperature, then the pulse width would return to the original value when operation at a more normal temperature is resumed.

Sampling pulses F are generally by circuit 80 during periods of light battery load, i.e. when no voltage is being applied to the stepping motor. As a result, switching element 94 is made conductive, causing the battery voltage to be applied to the non-grounded end of the resistor chain R1, R2 and R3, as shown in FIG. 6. The ratio of R1+R2/R3 is adjusted such that the voltage developed across R3, when 94 conducts, is equal to the threshold voltage level of inverter 100 if the battery voltage is at level V1. Thus, if the battery voltage is below V1, an output pulse is produced from inverter 100 when pulse E is generated. An output is thereby produced from AND gate 92, which is stored in latch 88. The output of latch 88 is applied to warning display signal shaping circuit 84, causing a warning display signal to be applied to waveform shaping circuit 74.

With regard to the arrangement of resistors R1, R2 and R3, both R1 and R2 are fixed resistors which are incorporated in a semiconductor chip containing the circuit components of the timepiece. R3 is a separately mounted variable resistor. This arrangement is based upon that fact that the range of variation of the battery voltage concerned is relatively small, i.e. in the case of a silver oxide battery the normal voltage is 1.5–1.55 V, V1 is from 1.4–1.45 V, and V2 is from 1.2–.3 V. Also, V1 is the more critical of the two detection voltage levels. Thus, adjustment of R3 is performed only with respect to level V1. The tolerances of R1, R2 and the threshold voltage of the inverter are such that predetermined fixed values for R1 and R2 will result in a correct setting being obtained for level V2 after adjustment of R3 for V1 has been performed.

It should be noted that R1 can be eliminated, and level V1 made equal to V2, without departing from the scope of the present invention. The invention can also be applied to batteries other than the silver oxide type normally used in electronic wristwatches. For example, the invention could be used to indicate that a rechargable battery has attained the fully charged state.

Figure 7:
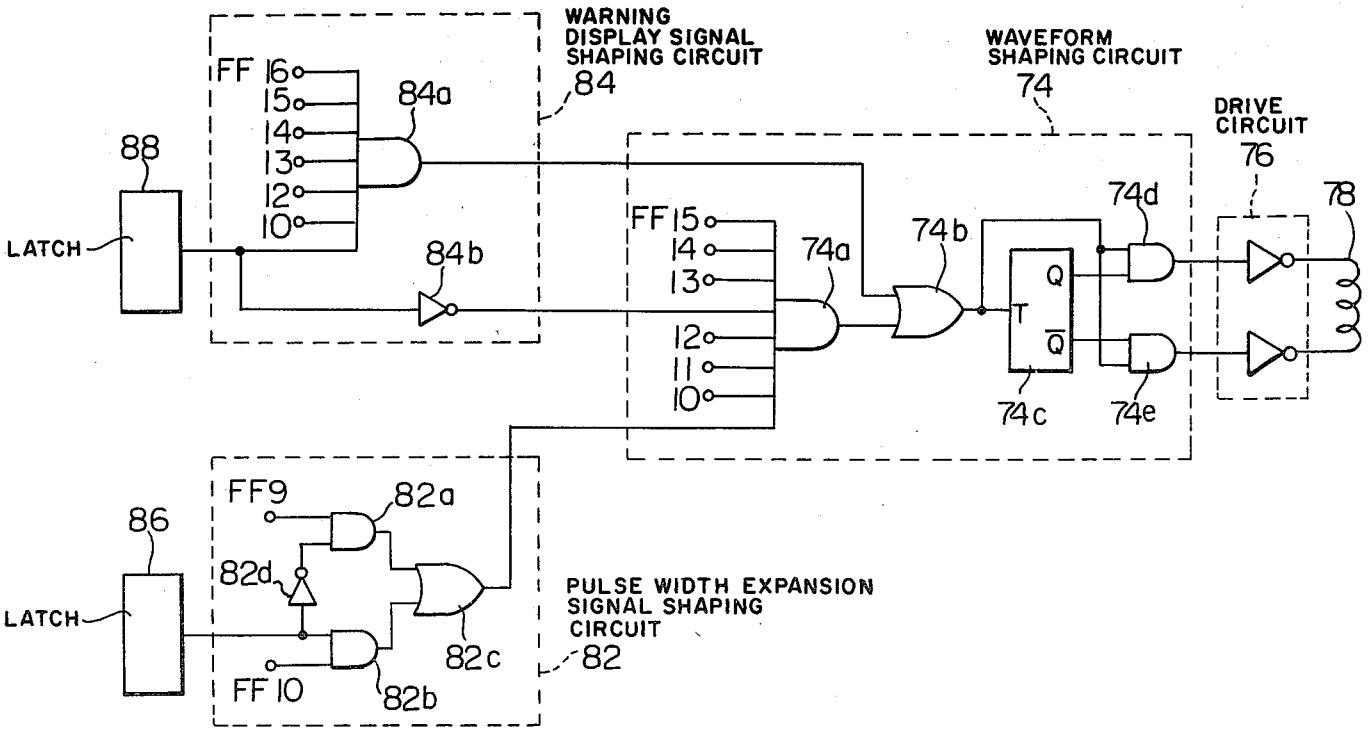
FIG. 7 is a diagram illustrating circuit arrangements for blocks 6, 7, 17 and 18 of FIG. 6.

Referring now to FIG. 7, circuit blocks 82, 84, 74 and 76 of FIG. 6 will be described in more detail. FF10 to FF16 shown in block 84 of FIG. 7 are the outputs from successive stages of frequency divider 74, with FF16 being the final stage and having a period of 4 seconds. FF10 to FF15, together with the output of OR gate 82*c* and the inverted output from latch 88, are applied to an AND gate 74*a*. FF15 has a period of 1 second.

Signal FF9 from frequency divider 72 has a pulse width of, say, 1/128 second. This represents the normal width of drive pulses applied to motor 78 when the battery voltage is above the detection threshold level V2. Signal FF10 has a pulse width of 1/64 seconds, for example, which is the width of pulses applied to motor 78 when the battery voltage falls below the detection threshold level V2. When no output is produced by latch 86, the output from inverter 82*d* is at the high logic level, causing pulses FF9 to pass to an input of AND gate 74*a* through AND gate 82*a* and OR gate 82*c*. If at this time no output is being produced by latch 88, then the output of inverter 84*b* will be at the high logic level. As a result of these inputs to AND gate 74*a*, pulses with a width of 1/128 seconds and period of 1 second are output from this gate and applied through OR gate 74*b* to AND gates 74*d* and 74*e*, and the T input of toggle-type flip-flop 74*c*. Outputs Q and $\overline{Q}$ of 74*c* will go to the high logic level alternately in response to successive pulses applied to terminal T. Thus, the output pulses from OR gate 74*b* will be alternately gated through AND gates 74*d* and 74*e*, causing a waveform as shown at A1 of FIG. 8 to appear across the coil of stepping motor 78. The seconds hand of the timepiece is thereby advanced once per second.

If the battery voltage falls below level V2 under heavy load, then an output is produced from latch 86, as described previously. As a result, AND gate 82*a* is inhibited and pulses with a width of 1/64 second are output from AND gate 82*b* and applied to AND gate 74*a* through OR gate 82*c*. Pulses with a width of 1/64 second are thereby output from AND gate 74*a*, causing the waveform shown at A2 of FIG. 8 to appear across the stepping motor coil. The seconds hand of the timepiece is thus advanced once per second, but with increased energy supplied for actuation, compensating for the drop in battery voltage below V2.

If the battery voltage should fall below level V1 under light load, then an output is produced from latch 88, as described previously. AND gate 84*a* is thereby enabled, and outputs pairs of output pulses, with a period of 2 seconds between each pair, and a period of 1/32 second, say, between each pulse in a pair. The width of each pulse is 1/64 second. The output from latch 88 is also applied to inverter 84*b*, whose output inhibits AND gate 74*a*. The output pulses from gate 84*a*, applied through OR gate 74*b*, AND gates 74*d* and 74*e*, and driver circuit 76, cause the waveform shown at A3 in FIG. 8 to appear across the coil of stepping motor 78. The seconds hand of the timepiece is thereby advanced by two steps, every two seconds, with increased energy supplied to the motor coil to compensate for the drop in battery voltages below V1. The user is thereby warned of the need for battery replacement.

Referring now to FIG. 9, a diagram illustrating the circuit arrangement of a modification of the second embodiment of the present invention is shown therein. In FIG. 9, circuit blocks 72, and components R1, R2, R3, switching elements 94 and 96 and inverter 100, correspond to the blocks and components having the same numerals indicated in FIG. 6, with respect to composition and function. The arrangement shown in FIG. 9 is of a timepiece with a liquid crystal type of display, in which a lamp 126 is built in so that the user can illuminate the display by depressing a switch S1, under conditions of low ambient light. This action causes a heavy load to be applied to battery 98. Numeral 108 indicates a frequency divider circuit, the output of which is applied to a decoder driver circuit 110. The output circuit 110 drives a liquid crystal display 112. Signals applied to a sampling pulse generating circuit 114 from circuit 108 cause circuit 114 to generate sampling pulses SA at a rate of, for example, one per 5 seconds. These pulse are applied to switching element 94, to an input of AND gate 120, and, serve as light load sampling pulses. Sampling inhibit pulses SB are also output from circuit 114, and are applied to a inhibit input of gate 122. Pulses SB are synchronized with sampling pulses SA, but the loading edge of said SB pulse occurs slightly before, and the trailing edge slightly after, the corresponding edge of an SA pulse, i.e. SB pulses overlap SA pulses in time.

The values of R1, R2 and adjustable resistor R3 are set to that inverter 100 produces a logically high output signal when a sampling pulse is applied with the battery voltage below level V1, as previously described with regard to FIG. 6. This output, applied together with the sampling pulses to the input terminals of AND gate 120, results in a high logic level output which is stored in latch 118. The output from latch 118 causes a warning control signal to be generated from circuit 116. This results in a warning signal appearing on the timepiece display 112, due to the action of the output from circuit 116 upon the decoder driver circuit 110. This warning can take the form of, for example, all or part of the display flashing on and off periodically. The user is thereby warned of the need for battery replacement.

If the user depresses switch S1, then so long as a sampling pulse is not in the course of being output from circuit 114, an output logical high signal will be produced from AND gate 122, and applied to the inputs of switching element 96, AND gate 128 and AND gate 136. Switching element 96 is thereby rendered conductive, and the battery voltage is thereby applied to the junction of R1 and R2. At this time, the output of timer 138 is at the low logic level, so that AND gate 128 output applies a positive potential to the base of transistor 130, rendering it conductive. Lamp 126 is thereby illuminated by current drawn from the battery 98, causing a heavy load to be applied to the battery. If the battery voltage now falls below voltage level V2 shown in FIG. 5, a high logic level output will be generated from inverter 100. AND gate 136 is thus caused to produce a high logic level output signal, which triggers timer 138, causing the timer output to go to the high logic level after from 0.5 to 1 second, and to remain at that level for a period of several seconds or several minutes. While the timer output is at this high logic level, AND gate 128 is inhibited, so that current to lamp 126 is cut off by transistor 130. This condition will persist until the timer output again goes to the low logic level, even if the user should depress switch S1 repeatedly.

Thus, the operation of the timekeeping circuitry is protected, since the battery voltage is prevented from dropping to a level at which such operation is affected, if the user should hold lamp illuminating switch S1 depressed while the battery is near the end of its life, or while the ambient operating temperature is extremely low.

An alternative arrangement of this modification would be to control the level of grain within the time standard oscillator circuit loop, when the battery voltage drops below a preset level due to a heavy load being applied. This could ensure that oscillation would continue under such a condition, to provide continued timekeeping.

Apart from a display illumination lamp, other functions which could be controlled as described above include, for example, an alarm buzzer, which can also apply a heavy battery load. Also, is possible to generate a display warning to indicate to the user that an excessive load is being applied to the battery.

Referring to FIG. 10, an example is shown therein of a combination of the first and second embodiments of the present invention, which have been previously described. Parts shown with numerals which appear in FIGS. 1 and 6 have the same functions and content as are given in the preceding descriptions accompanying these diagrams. In the example of FIG. 10, the light load sampling pulses S are produced by control pulse generating circuit 8, and the heavy load sampling pulses $O_1$ are produced by a waveform shaping circuit 74. Otherwise, the operation of battery voltage detection is performed as described previously for FIG. 1. The input signals to pulse width expansion control circuit 82 and to warning display signal control circuit 84 are generated by data-type flip-flops 17 and 16 respectively. Otherwise, the operation of circuit blocks 70, 72, 74, 76, 78, 80, 82 and 84 is as described previously for FIG. 6.

What is claimed is:

1. An electronic timepiece powered by a battery, comprising:

a frequency standard providing a relatively high frequency signal;

frequency converter means responsive to said relatively high frequency signal for providing first sampling signal and a standard time signal, each signal comprising a train of pulses and mutually differing in phase;

drive circuit means responsive to said standard time signal for producing a drive signal;

time indicating hands for displaying current time;

a motor responsive to said drive signal for advancing said time indicating hands in a normal mode of advancement;

a battery voltage detection circuit responsive to said first sampling signal for detecting when the voltage of said battery falls below a first predetermined level before said motor is driven and for producing a first control signal indicative thereof, and further responsive to said standard time signal for detecting a drop in voltage of said battery below a second predetermined level while said motor is being driven, and for producing a second control signal indicative thereof; and indication means responsive to said first and second control signals for selectively indicating that said battery voltage has fallen below said first and second predetermined levels.

2. An electronic timepiece according to claim 1, in which said indication means includes modulation of the advancement of said time indicating hands in a different mode from said normal mode of advancement.

3. An electronic timepiece according to claim 2, in which said frequency converter means further produces a plurality of low frequency signals, and further comprising a display pulse selector circuit responsive to said low frequency pulses in the absence of said first and second control signals for producing said standard time signal to be applied to said drive means and said battery voltage detection circuit, and responsive to said first control signal and said low frequency pulses for inhibiting said standard time signal and for producing a first compound pulse signal to be applied to said voltage detection circuit and to said drive means to thereby advance said time indicating hands in a first warning mode of advancement, and further responsive to said low frequency signals and said second control signal for producing a second compound pulse signal to be applied to said voltage detection circuit and to said drive means to thereby advance said time indicating hands in a second warning mode of advancement.

4. An electronic timepiece powered by a battery, comprising:

a frequency standard providing a relatively high frequency signal;

frequency converter means responsive to said relatively high frequency signal for providing a plurality of relatively low frequency signals;

time indicating means including time indicating hands and a motor for driving said time indicating hands;

circuit means for producing first and second sampling signals, said first sampling signal being produced during a time interval when said motor is being driven and said second sampling signal being produced at a point in time intermediate between time intervals when said motor is being driven;

battery voltage detection circuit means responsive to said first sampling signal for detecting a drop in the voltage of said battery below a predetermined level and for producing a first detection signal indicative thereof, and further responsive to said second sampling signal for detecting a drop in voltage of said battery below a second predetermined level and for producing a second detection signal indicative thereof;

memory means responsive to said first and second detection signals for producing first and second control signals, respectively;

drive circuit means responsive to a first group of said low frequency signals from said frequency converter means for generating a first drive signal to be applied to said motor, for thereby driving said time indicating hands in a normal mode of advancement, and responsive to a second group of said low frequency signals in conjunction with said first control signal for inhibiting the production of said first drive signal and for producing a second drive signal to be applied to said motor for thereby driving said time indicating hands in said normal mode of advancement, the pulse width of said second drive signal being greater than the pulse width of said first drive signal, and responsive to a third group of said low frequency signals in conjunction with said second control signal for producing a third drive signal to be applied to said motor and to inhibit the production of said first and second drive signals, the pulse width of said third drive signal being greater than the pulse width of said first drive signal, said third drive signal driving said motor to actuate said time indicating hands in a mode of advancement differing from said normal mode of advancement, for thereby providing a warning of the end of life of said battery.

5. An electronic timepiece according to claim 1, in which said first and second predetermined voltage levels of said battery are identical.

6. An electronic timepiece according to claim 1, in which said battery voltage detection circuit means comprises:

a resistive voltage divider;

a first field effect transistor having drain and source terminals connected between a terminal of said battery and one end of said resistive voltage divider and having a gate terminal coupled to receive said first sampling signal;

a second field effect transistor having drain and source terminals connected between said terminal of the battery and a first tap point of said resistive voltage divider and having a gate terminal coupled to receive said second sampling signal;

an amplifier circuit having an input terminal connected to a second tap point of said resistive frequency divider;

a first gate circuit coupled to receive the output signal from said amplifier circuit and said first sampling signal, for thereby producing said first detection signal; and a second gate circuit coupled to receive the output signal from said amplifier circuit and said second sampling signal, for thereby producing said second detection signal.

7. An electronic timepiece according to claim 6, in which at least one element of said resistive frequency divider is adjustable in value, for thereby enabling at least one of said first and second predetermined voltage levels of the battery to be set.

8. An electronic timepiece powered by a battery, comprising:

a frequency standard providing a relatively high frequency signal;

frequency converter means responsive to said relatively high frequency signal for providing a standard time signal and for producing a sampling signal;

drive means responsive to said standard time signal for producing a drive signal;

time indication means responsive to said drive signal for providing an indication of current time;

means for illuminating said time indication means; externally operated means for producing an illumination actuating signal;

drive means responsive to said illumination actuating signal for actuating said illumination means;

battery voltage detection circuit means responsive to said sampling signal for detecting a drop in voltage of said battery below a first predetermined level and for producing a first detection signal indicative thereof, and responsive to said illumination actuation signal for detecting a drop in voltage of said battery below a second predetermined level and producing a second detection signal indicative thereof;

first gate means responsive to said first and second detection signals for producing an output signal to be applied to said driver means, whereby said drive signal is modified to produce an indication by said time indication means of a drop in battery voltage below one of said first and second predetermined voltage levels;

second gate means responsive to second detection signal in conjunction with said illumination actuation signal for producing an output signal;

timer circuit means responsive to the output signal from said second gate means for producing an inhibit signal following a predetermined time interval after said output signal from the second gate means is initiated; and gate means coupled between said externally operated means for producing the illumination actuating signal and said illumination actuating drive means, being responsive to said inhibit signal from said timer circuit for inhibiting the application of said illumination actuating signal to said illumination actuating drive means.

9. An electronic timepiece according to claim 8, and further comprising:

means for producing a sampling inhibit signal, comprising a train of pulses synchronized with said sampling signal, with each pulse of said sampling inhibit signal overlapping a corresponding pulse of said sampling signal, with respect to time; and third gate means coupled to receive said illumination actuation signal and said sampling inhibit signal, whereby said illumination actuation signal is inhibited from being applied to said second gate means while a pulse of said sampling inhibit signal is being produced.

10. An electronic timepiece according to claim 8, in which said battery voltage detection circuit means comprises:

a resistive voltage divider;

a first field effect transistor having drain and source terminals connected between a terminal of said battery and one end of said resistive voltage divider, and having a gate terminal coupled to receive said sampling signal;

a second field effect transistor having drain and source terminals connected between said terminal of the battery and a first tap point of said resistive voltage divider, and having a gate terminal coupled to receive said illumination actuation signal; and an amplifier circuit having an input terminal connected to a second tap point of said resistive frequency divider.

11. An electronic timepiece according to claim 8, in which said time indication means comprises a liquid crystal display, and in which said drive means comprises a display drive and decoder circuit.

12. An electronic timepiece powered by a battery, comprising:

a frequency standard providing a relatively high frequency signal;

a frequency converter responsive to said relatively high frequency signal to provide a plurality of low frequency signals;

means for generating a drive signal in response to said plurality of low frequency signals;

time indicating means for providing a display of time information in response to said drive signal;

means for generating first and second sampling pulses representative of heavy battery load and light battery load, respectively, in response to selected ones of said plurality of low frequency signals;

means for detecting first and second voltage levels of said battery in response to said first and second sampling pulses, respectively and generating first and second detection signals indicative of said first and second voltage levels;

means for storing said first and second detection signals and generating first and second output signals indicative of said first and second detection signals, respectively;

said drive signal generating means including means for generating control signals in response to respective ones of said first and second output signals, said control signals serving to effect functions different from one another; and said time indicating means being responsive to at least one of said control signals to display said time information in a modulated form to indicate a battery life.

13. An electronic timepiece according to claim 12, in which said time indicating means comprises time indicating hands composed of an hours hand, a minutes hand, and a seconds hand to display said time information in a normal display mode in response to said drive signal, one of said time indicating hands being responsive to said at least one of said control signals and serving as means for indicating said battery life.

14. An electronic timepiece according to claim 13, in which said one of said time indicating hands is said seconds hand, said seconds hand advancing at a first speed rate to indicate a seconds of said time information in the absence of said at least one of said control signals and advancing at a second speed rate in the presence of said at least another one of said control signal to indicate said first voltage level of said battery.

15. An electronic timepiece according to claim 14, in which said seconds hand is responsive to another one of said control signals and advancing at a third speed rate to indicate said second voltage level of said battery.

16. An electronic timepiece according to claim 13, in which said drive signal generating means is responsive to said another one of said control signals to provide another drive signal having a pulse width larger than said first-mentioned drive signal.

17. An electronic timepiece according to claim 12, in which said time indicating means comprises a liquid crystal display cell, and further comprising a lamp to illuminate said liquid crystal display cell, and switch means for rendering said lamp operative when actuated.

18. An electronic timepiece according to claim 17, further comprising means for controlling the operation of said lamp in dependence on said one of said first and second voltage levels of said battery.

19. An electronic timepiece according to claim 18, in which said control means comprises means for cancelling the operation of said lamp in response to said control signal.

20. An electronic timepiece according to claim 13, in which said first sampling pulses comprise said drive signal indicating said heavy battery load.

21. An electronic timepiece according to claim 12, in which said means for detecting said first and second voltage levels comprises a common circuit to detect said first and second voltage levels.

* * * * *